US006170314B1

(12) United States Patent
Codatto

(10) Patent No.: US 6,170,314 B1
(45) Date of Patent: Jan. 9, 2001

(54) BENDING PRESS FOR FORMING CHANNEL-SHAPED BENDS IN THE EDGES OF A METAL SHEET

(76) Inventor: Antonio Codatto, Via Enrico Fermi 17, I-36045 Lonigo (Vicenza) (IT)

( * ) Notice: Under 35 U.S.C. 154(b), the term of this patent shall be extended for 0 days.

(21) Appl. No.: 09/402,925

(22) PCT Filed: Apr. 14, 1998

(86) PCT No.: PCT/EP98/02162

§ 371 Date: Dec. 14, 1999

§ 102(e) Date: Dec. 14, 1999

(87) PCT Pub. No.: WO98/46379

PCT Pub. Date: Oct. 22, 1998

(30) Foreign Application Priority Data

Apr. 15, 1997 (IT) ..... T097A0315

(51) Int. Cl.[7] ..... B21D 5/04

(52) U.S. Cl. ..... 72/316; 72/319; 72/478

(58) Field of Search ..... 72/319, 320, 323, 72/478, 446, 413, 316

(56) References Cited

U.S. PATENT DOCUMENTS

| | | | | |
|---|---|---|---|---|
| 4,660,402 | * | 4/1987 | Hongo | 72/478 |
| 5,313,814 | | 5/1994 | Yamamoto | 72/319 |
| 5,642,639 | * | 7/1997 | Codatto | 72/319 |

FOREIGN PATENT DOCUMENTS

WO 96 13346 5/1996 (WO) .

* cited by examiner

*Primary Examiner*—Daniel C. Crane
(74) *Attorney, Agent, or Firm*—Sughrue, Mion, Zinn, Macpeak & Seas, PLLC

(57) ABSTRACT

The movable blank-holder of a bending press includes a series of segments and a pair of motor-driven carriages each of which has an entraining member which can selectively engage and release the segments in order to move them for re-arrangement purposes. Each of two segments situated at opposite ends of the series includes a shoe-holder which supports a respective shoe by means of inclined guides. Each shoe-holder body carries a respective slide having a driving portion and each shoe has a driven portion. These driving and driven portions have facing cooperating pressure and sliding faces arranged in a manner such that a movement of the slide towards the center of the press is converted into an oblique movement of the respective shoe such that it is released from a lateral channel-shaped bend already formed in a metal sheet, without sliding on the sheet. Each carriage includes an entraining member and each slide includes an entrained member which can be engaged by the entraining member in order to move the slide selectively towards the center of the press. The two carriages are movable simultaneously in opposite directions upon command in order to simultaneously bring about the aforementioned movements of the shoes, by means of the slides, in directions such as to release them from the respective lateral bends. The shoes have respective resilient mechanisms for biasing them in directions to return each shoe to a working position to which it is moved away from the center of the press and from the movable blank-holder.

7 Claims, 4 Drawing Sheets

BENDING PRESS FOR FORMING CHANNEL-SHAPED BENDS IN THE EDGES OF A METAL SHEET

This is a national stage application of PCT/EP98/02162 application dated Apr. 14, 1998.

The present invention relates to a bending press for forming channel-shaped bends in the edges of a metal sheet.

BACKGROUND OF THE INVENTION

Conventional bending presses known from the document WO 96/13346.

A bending press according to one embodiment described and illustrated in the document WO 96/13346 comprises a pair of carriages which can be moved along its movable blank-holder in order to rearrange its segments. Each of these carriages comprises a first set of teeth fixed to the carriage, an input shaft housed in the shoe-holder body and connected to the first set of teeth by a toothed sprocket, a second set of teeth fixed to the shoe, and gearing for transmitting the drive of the input shaft to the second set of teeth.

This known mechanism enables the movements of the two shoes to be coordinated with the movements of the movable blank-holder, preferably by numerical control, in a manner such that, for movements of the movable blank-holder away from the fixed blank-holder there are corresponding simultaneous movements of the two shoes towards the centre of the press and towards the fixed blank-holder, without sliding of the shoes on the sheet. The two shoes are returned to the position in which they are moved away from the centre of the press by means of respective spiral springs or equivalent means incorporated in the shoe-holder body and interposed between it and the input shaft of the mechanism.

The mechanism according to document WO 96/13346 represented considerable progress in comparison with the prior art but has the disadvantage of being expensive because of the precision required in the manufacture and assembly of its components, particularly of its sets of teeth and its toothed sprockets.

SUMMARY OF THE INVENTION

The object of the invention is to provide a bending press of the type in question in which the function of controlling the movements of the shoes is performed by much simpler and more inexpensive means.

According to the invention, this object is achieved by means of a bending press in which.

According to the invention, the devices which transmit the movement of the carriages to the shoes in order to move them towards the centre of the press and towards the fixed blank-holder, that is, in order to release them from the channel-shaped bends without sliding on the sheet, do not comprise toothed members requiring very precise manufacture. As will be understood better from a reading of the detailed description given with reference to the drawings, according to the invention, these devices comprise very simple elements which operate by pressure and by relative sliding; even though the cooperating surfaces of these elements require a certain precision of manufacture, this precision does not involve such high costs as the manufacture of teeth.

BRIEF DESCRIPTION OF THE DRAWING

The invention will be understood better from a reading of the following detailed description, given by way of non-limiting example, with reference to the appended drawings, in which.

DETAILED DESCRIPTION OF THE PREFERRED EMBODIMENTS

Figure 1:
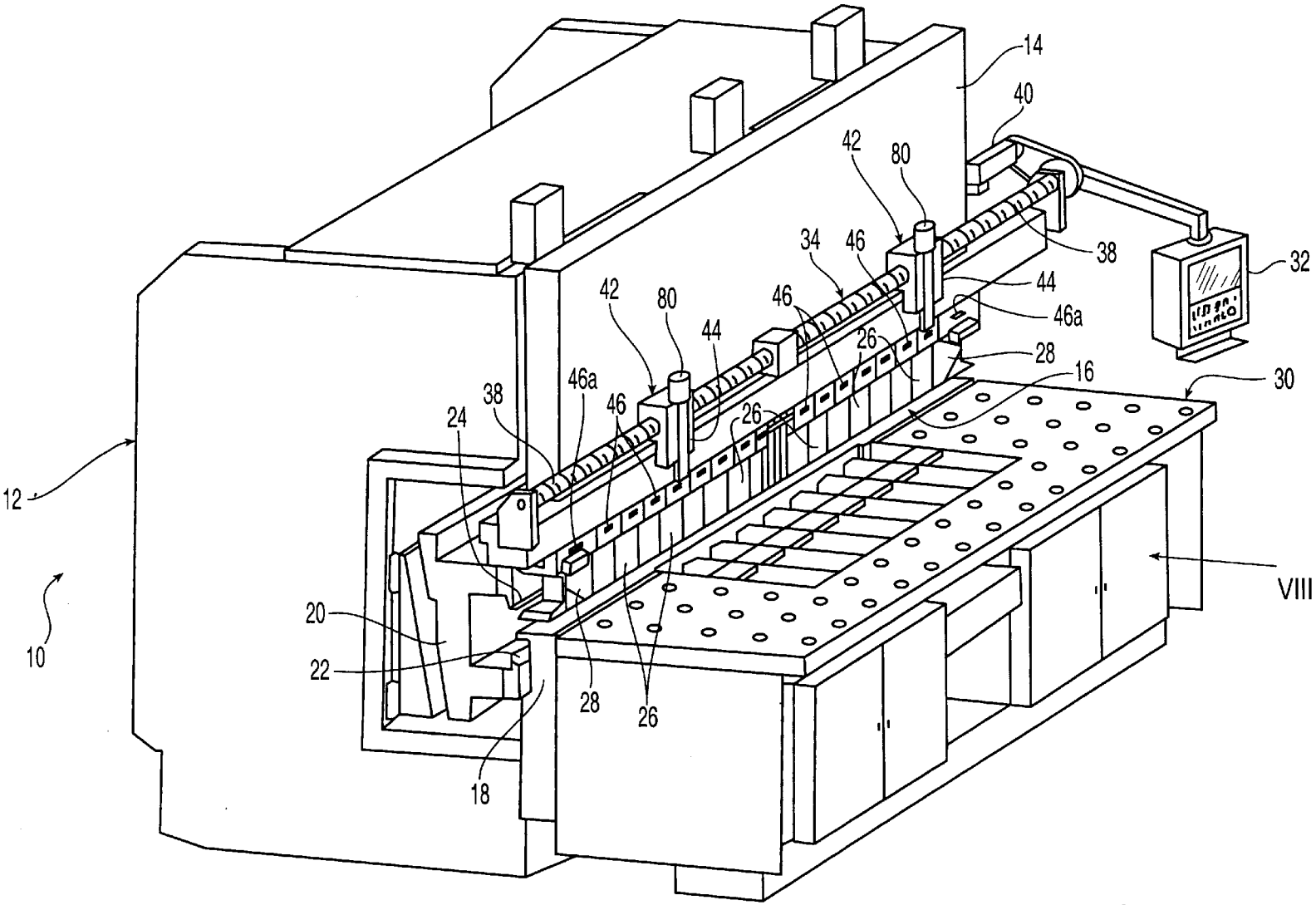
FIG. 1 is a schematic, perspective view of a bending press to which the invention is applied.

The embodiment shown in the drawings relates to the most common case of a press in which the movable blank-holder is the upper one, the fixed blank-holder is the lower one, and the plane of the metal sheet subjected to bending is horizontal.

The invention is not limited to this arrangement, however, since, by virtue of the fact that the movements of the shoes are brought about positively, it can be applied to other arrangements such as, for example, an arrangement in which the movable blank-holder is the lower one, or an arrangement in which the plane of the metal sheet is vertical and the movable blank-holder moves horizontally.

With reference to FIG. 1, a vertical bending press, generally indicated 10, comprises a strong channel-shaped frame, generally indicated 12.

A strong front plate 14 is slidable vertically on an upper front portion of the frame 12 and its lower portion carries an upper movable blank-holder, generally indicated 16, which will be referred to further below.

Upward and downward vertical movements of the front plate 14 and of the blank-holder 16 are brought about by one or more hydraulic actuators, not shown.

A lower front portion of the frame 12 carries a fixed blank-holder 18 with which the movable blank-holder 16 cooperates during bending operations.

A blade-holder 20 mounted in the cavity defined by the channel-shape of the frame 12 is also channel-shaped and carries a pair of bending blades, that is, a lower blade 22 and an upper blade 24.

The blade-holder 20 can be moved upwards and downwards and also advanced and retracted under the control of actuators which are preferably numerically controlled, in order selectively to cause its lower blade 22 to cooperate with the upper blank-holder 16 or its upper blade 24 with the lower blank-holder 18.

For further details relating to the blade-holder 20 and to its control actuators, reference should be made to an International patent application filed by the Applicant on the same date for "A sheet-metal bending press" and claiming priority of Italian patent application No. TO97A000314 of Apr. 15, 1997.

The upper movable blank-holder 16 is of the sectional type formed by a series of segments 26, for example, as in-the bending presses described and illustrated in the documents U.S. Pat. No. 4 089 198 and WO 96/13346.

The series of segments 26 comprises two special segments, indicated 28, which are spaced apart so as to correspond to opposite lateral edges of a metal sheet. In FIGS. 1, 2 and 8 to 10, these segments 28 are arranged at the two ends of the series of segments, that is, in positions corresponding to the maximum useful width of the press.

As shown in FIG. 1, on the front of the press 10 there is a table 30 for supporting metal sheets being bent. The table 30 is preferably served by a manipulator (not shown).

All of the movements of the press and of its manipulator are preferably controlled by a numerical control device, conventionally indicated by means of a suspended "console" 32 thereof.

A translation bar 34 extending along the movable blank-holder 16 comprises two portions 38 which are threaded in opposite directions.

The bar 34 can be rotated selectively by a numerically-controlled electric motor 40.

The two portions 38 of the bar 34 which are threaded in opposite directions carry respective carriages 42 coupled to these threaded portions by means of respective female threads, not shown. The two carriages 42 are provided for rearranging the segments 26 of the movable blank-holder 16 each time such rearrangement is necessary in order to adapt the blank-holder 16 to the width of a specific sheet to be bent.

With reference to FIGS. 1, 2, 6, 7 and 8 to 10, in order to perform these operations to rearrange the segments 26, each carriage 42 has a respective entraining member 44, further details of which will be given below.

For the moment, it will suffice to state that an upper portion of each of the segments 26 has a respective entrained member constituted by a front projection 46 which can be engaged by a respective entraining member 44.

Further details of the entraining members 44, of the entrained members 46, and of their cooperation will be given below. For the moment it will suffice to state that the left-hand carriage 42 of FIGS. 1 and 8 to 10 is arranged for moving segments 26 situated to the left of the centre of the press and the right-hand carriage 42 with its entraining member 44 is arranged for simultaneously moving right-hand segments 26 in the opposite direction.

With reference to FIGS. 2 to 4 and 6 to 10, each end segment 28 comprises a shoe-holder body 48 which acts as the actual segment and has, for its rearrange ment by the respective carriage 42, an entrained member 46a in the form of a front projection just like the projections 46 and aligned therewith.

Each body 48 supports a shoe 50 with a lower beak-like projection 52.

Figure 8:
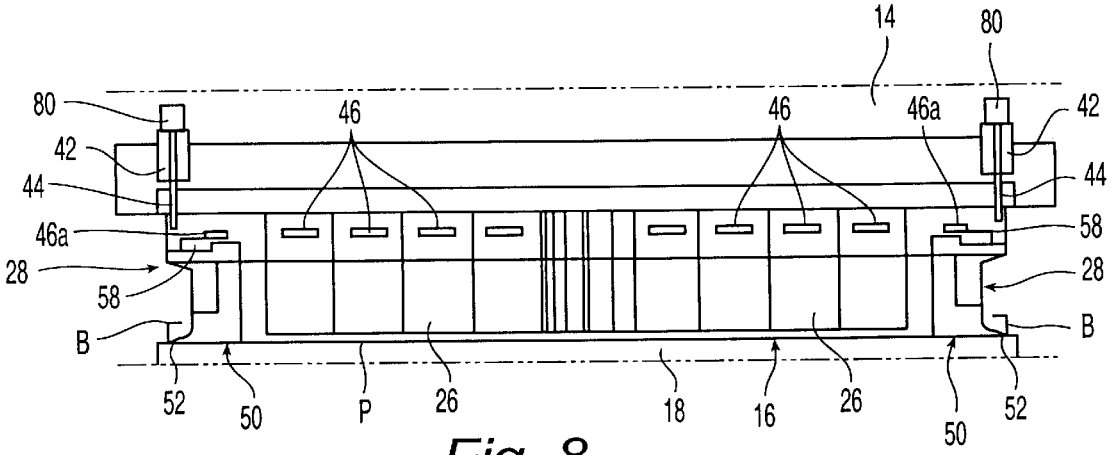
FIGS. 8, 9 and 10 are partial schematic front views taken on the arrow VIII of FIG. 1 showing three successive stages of the release of the movable blank-holder of the press and of its shoes from a metal sheet two opposite edges of which already have channel-shaped bends.
Figure 9:
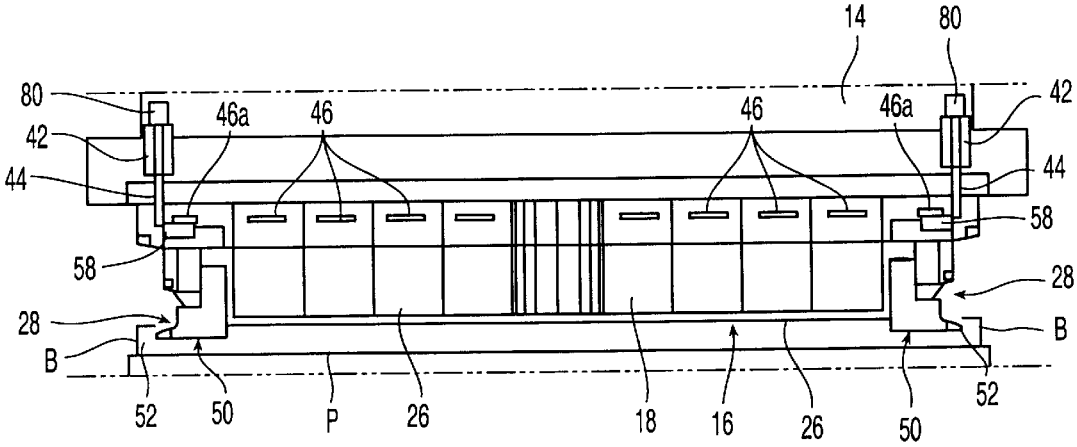
Figure 10:
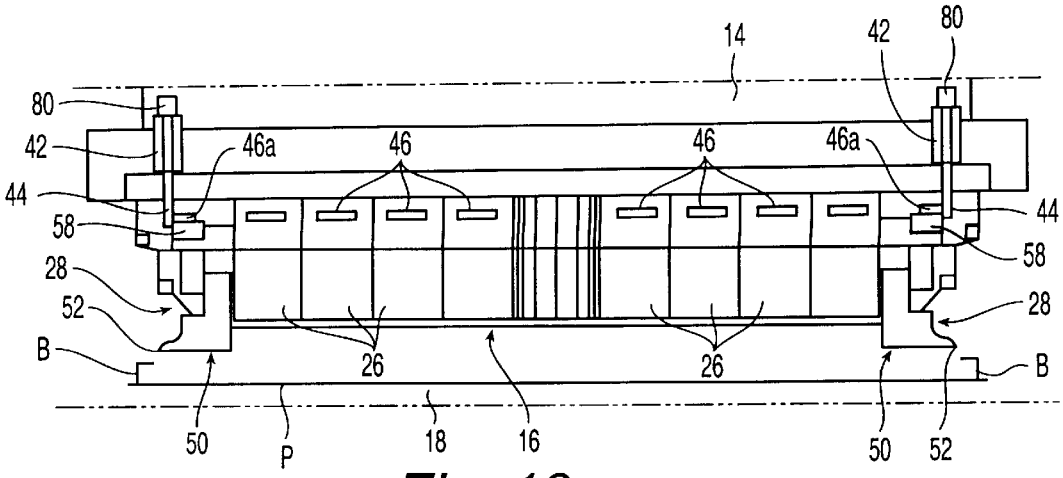

As can be seen, for example, in FIGS. 8 to 10, the projections 52 of each shoe 50 extend in opposite directions so that each can be inserted in a lateral channel-shaped bend, indicated B, already formed in a metal sheet P.

Each shoe 50 is supported by its body 48 by means of inclined guides 54, preferably oriented at 45° to the plane of the metal sheet P (FIGS. 8 to 10) to be bent.

Figure 5:
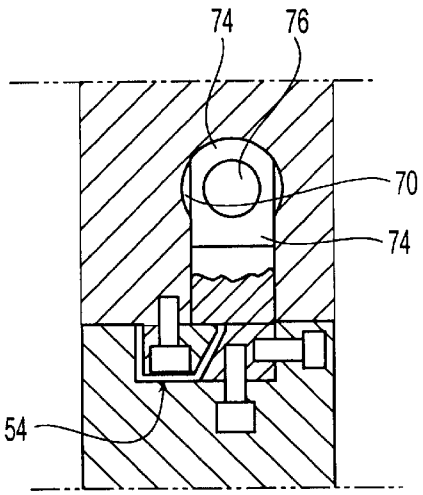
FIG. 5 is a section of a detail taken on the line V—V of FIG. 4, FIGS. 6 and 7 are front elevational views taken on the arrow VI of FIG. 2 showing the shoe of the unit in the position to which it is moved away from the centre of the press and from the fixed blank-holder, and in the position to which it is moved towards the centre of the press and towards the fixed blank-holder, respectively.

The cross-section of the guides 54, which is similar to a dovetail, is visible in FIG. 5.

Figure 2:
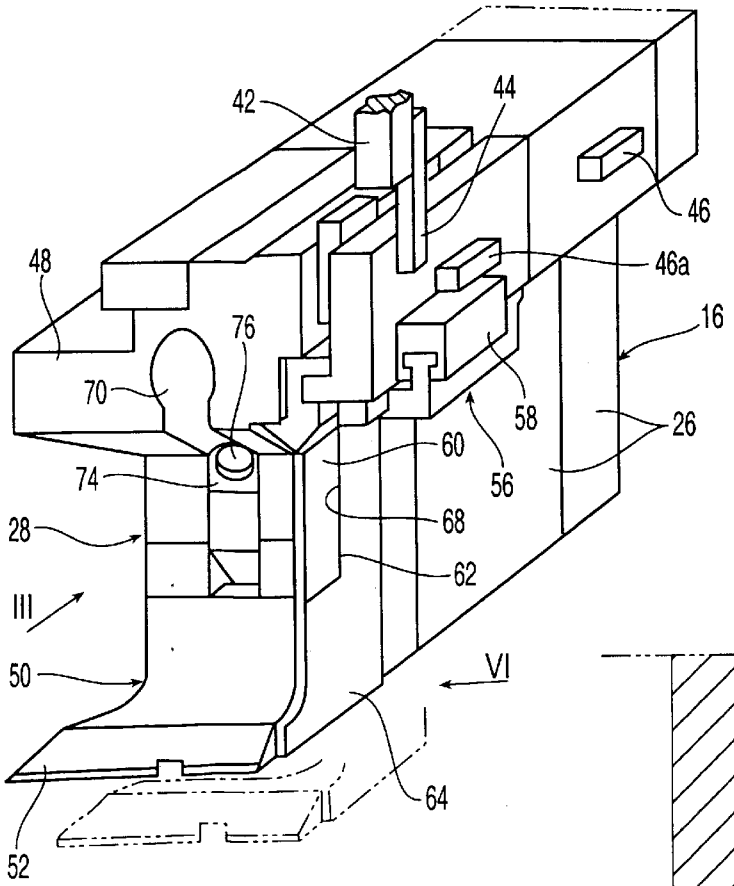
FIG. 2 is a perspective view of an end region of the movable blank-holder of the press of FIG. 1, on an enlarged scale, including one of the two shoe/shoe-holder units (the left-hand one closer to the observer in FIG. 1), it being understood that the other shoe/shoe-holder unit is formed as mirror image thereof.
Figure 7:
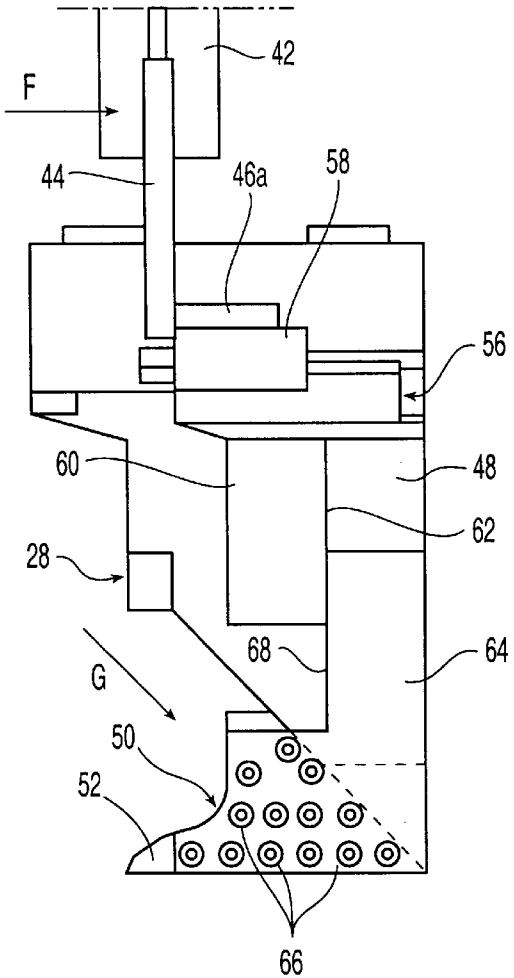
Figure 6:
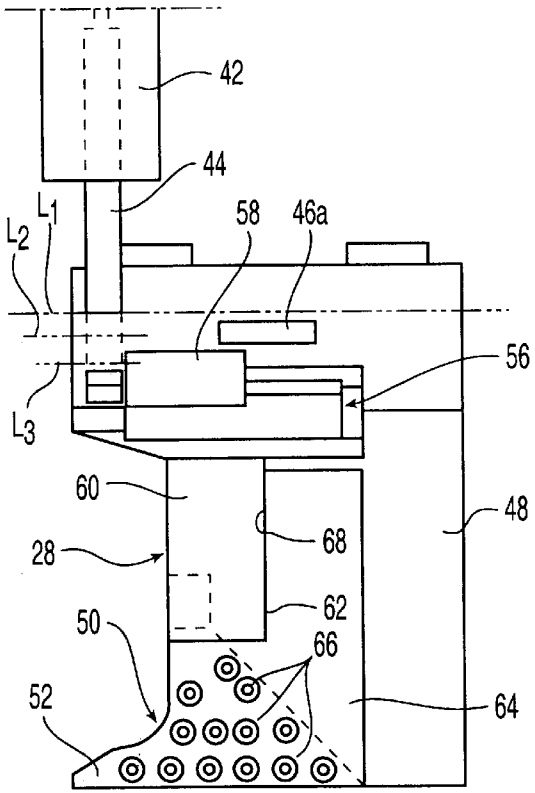
Figure 4:
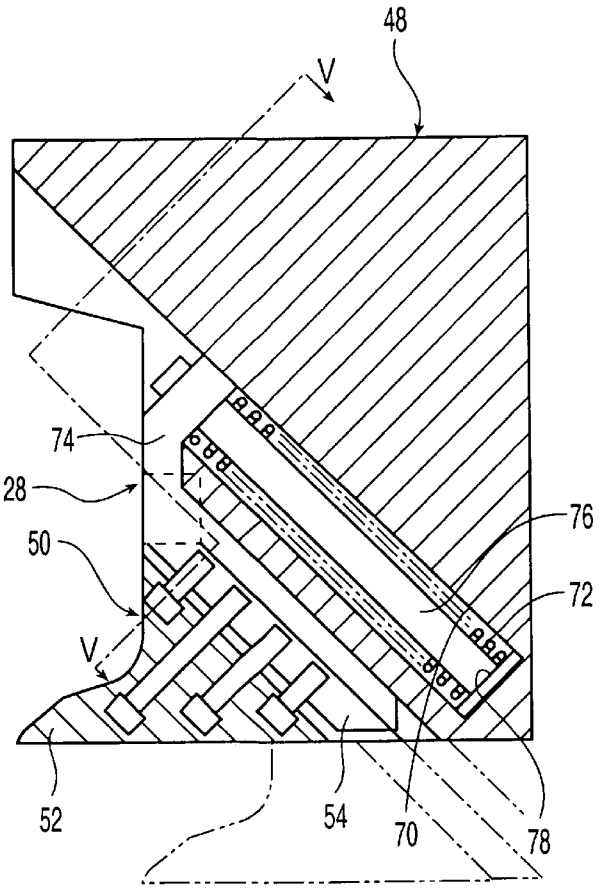
FIG. 4 is a section taken in the plane indicated IV—IV in FIG. 3.

Each shoe 50 can move along the guides 54 between a working or engagement position, shown in continuous outline in FIGS. 2 and 4 as well as in FIG. 6, and a release position, shown in broken outline in FIGS. 2 and 4, as well as in FIG. 7.

Means which, in accordance with a preferred embodiment of the invention, serve for converting the movements of the carriages 42 along the translation bar 34 from the working position to the release position, as well as returning them from the release position to the working position, will now be described with reference to FIGS. 2 to 7.

Each shoe-holder body 48 carries a respective slide 56 slidable on the body 48 in directions parallel to the directions of movement of the carriage 42.

An abutment in the form of a block 58, the function of which will be referred to further below, is fixed to the slide 56 so as to be adjustable in the same directions.

A driving portion 60 in the form of a vertically elongate plate-like portion is fixed to the slide 56. The plate-like portion 60 is fitted flat on a front face of the shoe-holder body 28 and is substantially coplanar with the front faces of the segments 26.

An edge of the plate-like portion 60, indicated 62, facing laterally inwardly relative to the press, extends vertically, that is, in the direction of movement of the movable blank-holder 16.

Each shoe 50 has a driven portion 64 fixed thereto. In the preferred embodiment shown in the drawings, the driven portion 64 is constituted by a plate fixed to the front of the shoe 50 by means of a series of screws 66, the heads of which are shown schematically in FIGS. 6 and 7.

A straight lateral edge of the plate 64, indicated 68, is parallel to and faces the straight edge 62.

As will be seen from the following, the two edges 62 and 68 constitute facing cooperating pressure and sliding surfaces arranged in a manner such that a movement of the slide 56 towards the centre of the press is converted by the cooperation of the facing surfaces 62, 68 with pressure and sliding into a movement of the shoe 50 from the working position of FIG. 6 to the release position of FIG. 7.

This movement is controlled positively by the respective carriage 42 in the manner which will be explained below.

A resilient biasing means, an embodiment of which is shown in FIG. 4, is provided for returning the shoe 50 from the release position to the working position.

Figure 3:
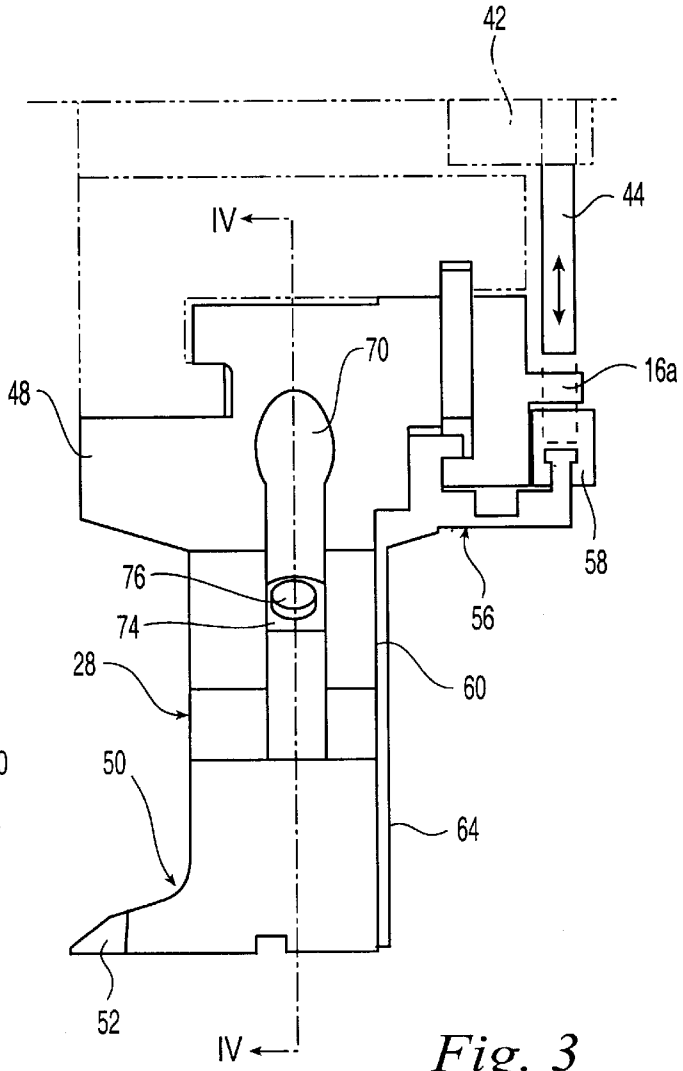
FIG. 3 is a side elevational view taken on the arrow III of FIG. 2.

With reference to FIG. 4, each shoe-holder body 48 has a recess 70 also visible in FIGS. 2, 3 and 5. This recess 70 extends parallel to the inclined guides 54 and contains, as resilient biasing means, at least one helical compression biasing spring 72.

The shoe 50 has an appendage 74, also visible in FIGS. 2, 3 and 5, which is slidable along a fixed rod 76 extending through the spring 70 for centring purposes.

The spring 70 reacts against an end wall 78 of the cavity 70 at one end and against the appendage 74 at the other end.

When the shoe 50 moves from the working position of FIG. 6 to the release position of FIG. 7, the spring 72 is compressed and biases the shoe in the opposite direction by virtue of the release of its compression energy.

Reference will now be made to FIGS. 2, 3, 6 and 7 to describe the details of the entraining member 44 of each carriage 42 and the way in which it serves to bring about the movement of the respective shoe 50 from the working position to the release position.

The entraining member 44 is in the form of a bar slidable vertically, that is, in the direction of movement of the movable blank-holder 16, in the respective carriage 42.

The top of the bar 44 is connected to the rod of a respective linear actuator 80 (FIG. 1), which is preferably numerically controlled.

The actuator 80 can move the bar between a position in which it is raised, that is, retracted, relative to the fixed blank-holder 18, an intermediate position, and a position in which it is lowered, that is, advanced relative to the fixed blank-holder 18.

In FIG. 6, the level of the lower end of the bar 44 in the retracted position is indicated L1, the level of this end in the intermediate position is indicated L2, and its level in the advanced position is indicated L3.

When the bar 44 is retracted, its end which is at the level L1 is above all of the projections or entrained members 46, 46*a* and any movements of the carriage 42 have no effect.

When the bar 44 is in the intermediate position, its end which is at the level L2 is in a position such that it interferes with the projections 46, 46*a* and the segments 26, 28 can be arranged by means of the movements of the carriage 42, by virtue of the engagement of the bar 44 with lateral pressure with the selected projection 46 or 46*a*.

In order to bring about the movements of the shoes from the working position of FIG. 6 to the release position of FIG. 7, the bars 44 of the two carriages 42 are brought to the advanced position corresponding to the level L3, as shown in FIG. 6 in broken outline, and in FIG. 7.

In this position, the bar 44 is so arranged as to interfere with the projection or abutment 58 of the slide 56 on its side facing outwardly relative to the press.

In these conditions, a movement of the carriage 42 towards the centre of the press in the direction of the arrow F of FIG. 7 is converted into a corresponding movement of the slide 56 by virtue of the engagement of the bar 44 with the abutment or projection 58.

During this movement, the edge 62 of the driving member constituted by the plate-shaped portion 60 of the slide 56 engages the edge 68 of the plate 64 of the shoe 50.

By virtue of the inclined guides 54, the pressure of the edge 62 on the edge 68 is translated into a movement of the shoe 50 in the direction of the arrow G of FIG. 7, during which movement the edge 68 moves downwardly along the edge 62.

The arrangement is such that, when the shoe 50 reaches the release position of FIG. 7, the bar 44 strikes the projection 46*a* which constitutes a travel-limit stop.

This travel-limit position can be adjusted by adjustment of the position of the abutment or projection 58 along the slide 56.

Reference will now be made to FIGS. 8, 9 and 10 to describe the coordinated sequence of movements of the blank-holder 16 and of its end shoes 50, both of which movements are preferably controlled by the numerical-control device 32 of FIG. 1.

In FIG. 8, the metal sheet P is gripped between the upper blank-holder 16 and the lower blank-holder 18. The two shoes 50 are in the respective working positions of FIG. 6 in which they are moved apart and away from the centre of the press and their beak-like projections 52 are fitted in the respective lateral bends B in the sheet P.

With reference to FIG. 9, in order to be able to release the sheet P from the press, the numerical control device 32 (FIG. 1) brings about upward movement of the movable blank-holder 16 and, at the same time, oblique movement of the two shoes 50 towards their release positions in the direction of the arrow G of FIG. 7. The movements are coordinated in a manner such that, as soon as the movable blank-holder 16 is detached from the sheet P, the shoes 50 are also detached from the sheet P whilst starting to move in the direction of the arrow G of FIG. 7, so that they never slide on the panel.

FIG. 10 shows the final condition in which the movable blank-holder 16 is raised and the shoes 50 are moved the maximum distance towards one another and have reached the final release position of FIG. 7. In this position, the projections 52 no longer interfere with the bends B.

When the upper blank-holder 16 is lowered against a sheet P for bending purposes, the movements of the blank-holder 16 and of the shoes 50, which are coordinated by the numerical-control device 32 of FIG. 1, take place in the opposite directions by virtue of the biasing force of the springs 72 of FIG. 4, again without sliding of the shoes 50 on the sheet P.

FIG. 1 shows a bending press which comprises a pair of blades cooperating with respective opposed blades forming part of respective blank-holders.

The invention may, however, be applied to a press even having only one pair of bending tools (blade and opposed blade), in particular in order to form one or more bends in an edge of a metal sheet in a direction perpendicular to that of the opposed channel-shaped bends indicated B in FIGS. 8 to 10.

What is claimed is:

1. A bending press which forms at least one bend in an edge of a metal sheet of which at least one lateral edge perpendicular to an edge to be bent has already been bent into a channel-shape, comprising:

a pair of opposed blank-holders, said blank-holders including a movable blank-holder and a fixed blank-holder, and at least one bending blade cooperating with the movable blank-holder, wherein the movable blank-holder includes a series of segments movable along the blank-holder and equipped with a pair of motor-driven carriages, movable in a horizontal direction, each of which has an entraining member which can selectively engage and release the segments in order to move the segments for rearrangement purposes, wherein each of two segments situated at opposite ends of the series includes a shoe-holder body which supports a respective shoe by means of inclined guides converging towards the fixed blank-holder, wherein the two shoes have projections extending in opposite directions for insertion in respective channel-shaped bends which have already been formed, wherein each carriage can bring about a movement of a respective shoe along its inclined guides in a direction towards a centre of the press, towards said segments and towards the fixed blank-holder whilst the movable blank-holder is moving away from the fixed blank-holder after formation of the bend, and wherein the shoes have respective means for resiliently biasing the shoes away from the centre of the press and from the movable blank-holder, wherein each shoe-holder body carries a respective slide movable parallel to the direction of movement of the respective carriage, wherein each slide has a driving portion and each shoe has a driven portion, the driving and driven portions having facing, cooperating pressure and sliding surfaces arranged in a manner such that a movement of the slide towards the centre of the press is converted by the cooperation of the facing surfaces with pressure and sliding into an oblique movement of the respective shoe along the respective inclined guide towards the centre of the press and towards the fixed blank-holder, wherein each carriage includes an entraining member and each slide includes an entrained member which can be engaged by the entraining member of the respective carriage in order to move the slide selectively towards the centre of the press, and wherein the two carriages are movable simultaneously in opposite directions upon command in order to simultaneously to bring about the aforementioned movements of the shoes by means of the slides.

2. A bending press according to claim 1, wherein each carriage includes a single entraining member for selectively moving the segments for rearrangement purposes and for engaging the entrained member of a respective slide in order to move the slide towards the centre of the press.

3. A bending press according to claim 2, wherein the entraining member of each carriage includes a bar extending in a direction of movement of the movable blank-holder and movable by a respective actuator in the direction of the movable blank-holder between a first position in which the movable blank-holder is retracted relative to the fixed blank-holder, a second intermediate position, and a third position in which the movable blank-holder is advanced relative to the fixed blank-holder, in that each segment has a first front projection which can be engaged laterally by the bar for the purposes of rearrangement of the segments, in that each slide has a second front projection which can be engaged laterally by the bar of the respective carriage to move the slide in a direction corresponding to an inward movement of the shoe toward the center of the press, and in that an arrangement of the bar and of the projections is such that, in the intermediate position, the bar can engage only the projections of the segments, including the projection of the respective shoe-holder body and, in the advanced third position, the bar can engage the projection of the respective slide.

4. A bending press according to claim 3, wherein, when the slide is in a position farthest from the centre of the press, the projection of the slide is farther from a centre than the projection of the shoe-holder body and the projection of the shoe-holder body is arranged to include, in the direction in which the movable blank-holder extends, a lateral travel abutment for the bar in a position of the slide which corresponds to a position in which the shoe is moved towards the fixed blank-holder and towards the centre of the press.

5. A bending press according to claim 1, wherein the said driven portion includes a plate fixed to a front of the respective shoe and having, as a facing surface, a first straight edge extending in the direction of movement of the movable blank-holder, perpendicular to the direction of movement of the slide, and facing laterally outwardly relative to the press, and the respective driving portion includes a plate-like portion projecting from the carriage, coplanar with the plate fixed to the shoe, and having, as a facing surface, a second straight edge parallel to the first straight edge of the plate, fixed to the shoe, and facing laterally inwardly relative to the press.

6. A bending press according to claim 1, wherein each resilient biasing means includes at least one helical compression biasing spring which extends parallel to a respective inclined guide, is housed in a recess in the shoe-holder body, and reacts against an end wall of the recess at one end and against an appendage of the shoe at the other end.

7. A bending press according to claim 3, further comprising a threaded translation bar extending along the movable blank-holder and having two portions threaded in opposite directions and coupled with respective female threads of the respective carriages, and a numerically-controlled electric motor for rotating the threaded bar, in that each carriage carries a numerically-controlled actuator for moving the respective threaded bar and in that the bending press includes a numerical-control unit which controls the motor and the actuators in coordination with the means for controlling the movable blank-holder such that, for movements of the movable blank-holder away from and towards the fixed blank-holder, there are respective corresponding movements of the shoes towards one another and apart, without sliding of the shoes on the metal sheet interposed between the two blank-holders.

* * * * *